US006443086B1

(12) United States Patent
Actis-Grande et al.

(10) Patent No.: US 6,443,086 B1
(45) Date of Patent: Sep. 3, 2002

(54) BOAT MOORING SYSTEM

(76) Inventors: Richard Actis-Grande, 6, rue Villersoxel, Paris (FR), 75007; Matthew Baird, II, 50 White St., 4th Floor, New York, NY (US) 10013; E. Hewlett Kent, 520 Middle Rd., Gulf Stream, FL (US) 33483

( * ) Notice: Subject to any disclaimer, the term of this patent is extended or adjusted under 35 U.S.C. 154(b) by 0 days.

(21) Appl. No.: 09/982,556

(22) Filed: Oct. 18, 2001

(51) Int. Cl.[7] ..... B63B 21/00

(52) U.S. Cl. ..... 114/230.24; 114/230.2; 114/215; 267/73

(58) Field of Search ..... 114/230.1, 230.2, 114/230.22, 230.24, 230.25, 230.26, 230.27, 215; 267/69, 70, 71, 72, 73, 74

(56) References Cited

U.S. PATENT DOCUMENTS 511,251 A * 12/1893 Pickles ..... 482/129
546,788 A * 9/1895 Sheldon ..... 114/215
2,364,901 A * 12/1944 Hicks ..... 267/70
2,482,851 A * 9/1949 Jennewein ..... 211/119.1
3,018,507 A * 1/1962 Launer ..... 16/78
3,051,448 A * 8/1962 Pletta ..... 114/230.24
3,129,688 A * 4/1964 Buchholz ..... 114/230.24
3,788,258 A * 1/1974 Odom ..... 114/230.24
3,958,367 A * 5/1976 Fairman ..... 49/197
4,082,133 A * 4/1978 Halapoff ..... 160/191
4,757,853 A * 7/1988 Price ..... 160/191
5,421,530 A * 6/1995 Bertagna et al. ..... 242/388.91

* cited by examiner

*Primary Examiner*—S. Joseph Morano
*Assistant Examiner*—Ajay Vasudeva
(74) *Attorney, Agent, or Firm*—Bazerman & Drangel, PC

(57) ABSTRACT

The present invention is a boat mooring system for stabilizing a boat while docked which allows the effective length of the mooring line to vary for substantially greater distances than that of the prior art. The boat mooring system contains a multi pulley arrangement such that a small movement in a spring tensioning device results in a substantial change in the effective length of the mooring line. Thus, a change in tide, or weather conditions results in a substantial compensating effect.

14 Claims, 5 Drawing Sheets

BOAT MOORING SYSTEM

BACKGROUND OF THE INVENTION

1. Field of the Invention

The present invention relates generally to docking and mooring systems for boats, more particularly, to a system which allows the mooring lines to substantially vary in effective length depending on the tide, wave action, wind or other factors.

2. Description of the Prior Art

Water is far from a stable surface. Tides, winds and waves rise and fall. When not in use, boats are normally attached or moored to a fixed object and allowed to float in the water. If simple mooring lines are used to attach a boat to a dock or in a slip, the combined actions of tide, wind and wave can injure the boat. If the lines are too taught, a rising or falling tide can stress the boat by pulling the boat above or below its natural level in the water. If, however, the lines are slack to allow for tides, wave and wind, these forces can slam the boat into its dock.

Various boat docking devices to prevent such damage are known and range in complexity from the use of floats to involved spring systems to counteract the forces of nature. These attempt to maintain the boat's position by varying the mooring line's effective length. For example, U.S. Pat. No. 5,694,879, issued on Dec. 9, 1997 to James Taylor, discloses a mooring device which is mounted between the dock and the boat. The line from the dock is attached to one end of a spring while the line from the boat is attached to the other end of a spring. Similarly, U.S. Pat. No. 4,022,450, issued to Smith, Jr. on May 10, 1977; U.S. Pat. No. 4,754,957, issued to Muttart on Jul. 5, 1988; U.S. Pat. No. 5,307,753, issued to Besonen, Sr., et al. on May 3, 1994; U.S. Pat. No. 5,450,808, issued to Beagan on Sep. 19, 1995; and U.S. Pat. 5,482,258, issued to Clauson on Jan. 9, 1996 disclose systems of one or more springs interposed between two lines, one from the boat to the device and one from the device to the dock. In each case the amount of play in the system is limited to the length of the spring movement. U.S. Pat. No. 5,749,535, issued to Kahn, III on May 12, 1998, discloses a piston and spring deceleration device for use with boat moorings where a traveling pulley is used to gain limited additional travel for the line. The traveling pulley movement is limited to the travel of the piston. Other methods for controlling the tension include the use of weights such as seen in U.S. Pat. No. 5,265,553 to Brydges, dated Nov. 30, 1993, or by floats as seen in U.S. Pat. No. 5,603 280, issued on Feb. 18, 1997 to Shackelford, Jr.; U.S. Pat. No. 5,716,249, issued on Feb. 10, 1998 to Dyhrberg. Here, travel is limited to the movement of the float or weight.

Each suffers from the same disability. The play in the mooring line is severely limited by the travel of the spring, float or weight as it responds to the load on the line. In other words, either the change in the effective length of the mooring line is small or the mooring system must be very large to accommodate corresponding large changes in the effective length of the mooring line.

BRIEF SUMMARY OF THE INVENTION

The present invention is a boat mooring system for stabilizing a boat while docked which allows the effective length of the mooring line to vary for substantially greater distances than that of the prior art. The boat mooring system contains a multi pulley arrangement such that a small movement in a spring tensioning device results in a substantial change in the effective length of the mooring line. Thus, a change in tide, or weather conditions results in a substantial compensating effect.

To accomplish this desired result, one end of a spring is fixed in position at the first end of the device. A first floating pulley is attached to the other end of the spring. A first line is fixed at the second end of the device, opposite the first end of the device. The first line passes through the first floating pulley, then passes through a fixed pulley at the second end of the device and is then attached to and supports a second floating pulley. The mooring line from the boat passes through the second floating pulley, around a pulley fixed to the first end of the device and is then attached to the bottom of the second floating pulley.

The device is mounted in a closed case on pilings facing towards a dock or slip where the boat will be docked. The outer case of the device is made of a durable material which will not deteriorate when subject to drastic changes in the environment. Both upper and lower ends of the case are closed by solid plates. The front of the boat mooring system has an opening and guide to allow the second line to move freely in and out of the device.

The second line can be pulled from the device for attachment to the boat. The side of the boat opposite the pilings on which the device is mounted is fastened to a dock or a piling using a fixed line.

When the water level or weather conditions change, the pulleys and spring of the present invention will allow the rope to adjust its length according to the tension on the mooring line. The effective length of the line is not limited to the travel distance of the spring due to the pulley arrangement of the present invention.

Since the boat mooring system of the present invention is fixedly mounted on pilings, the boat need only carry conventional mooring lines. Different boats of different sizes, types and tonnage may use the same mooring system in the same slip. Unlike other mooring systems, the body of the present invention does not come in contact with the boat. This reduces the risk of damage to the boat.

DESCRIPTION OF THE PREFERRED EMBODIMENT

Figure 1:
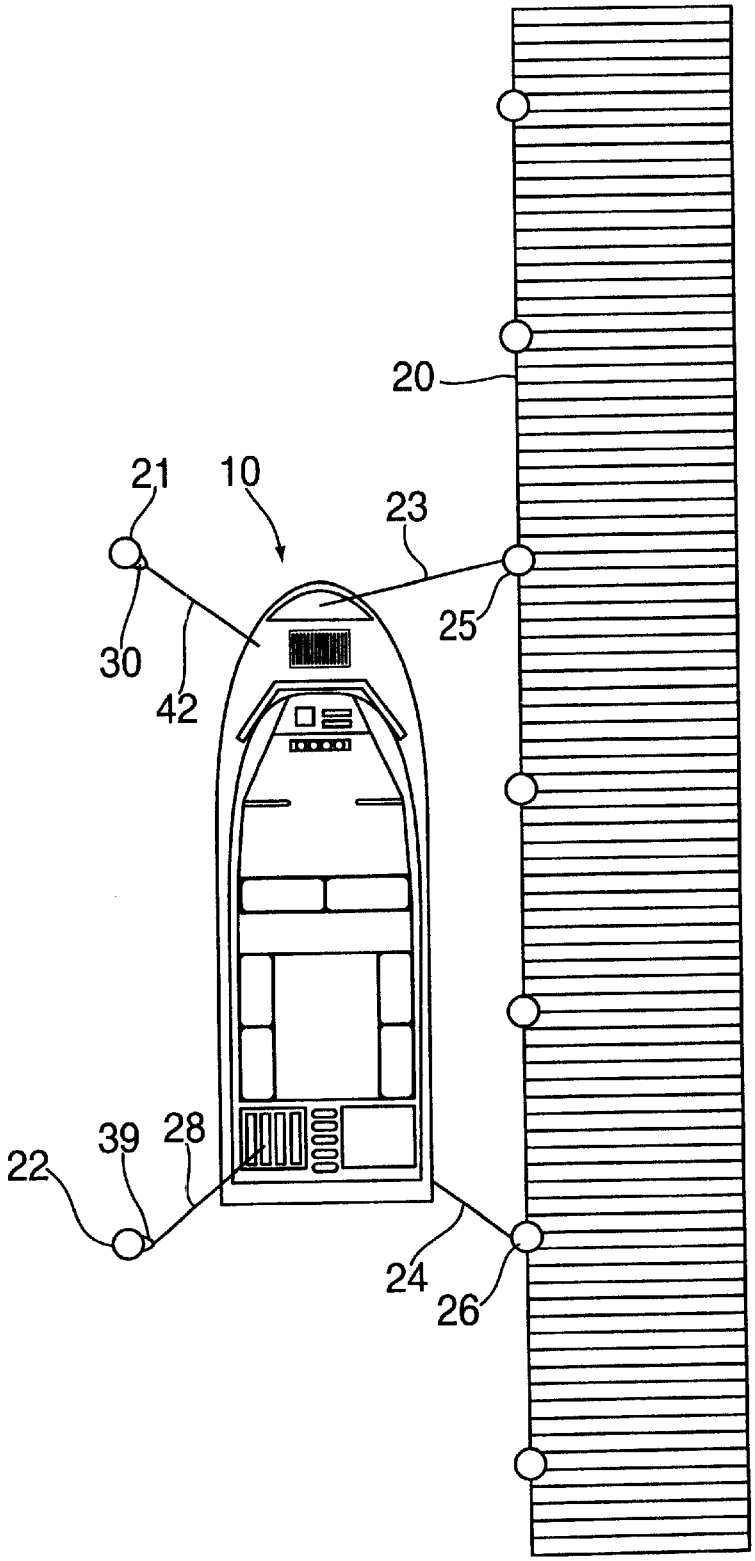
FIG. 1 is a top view of a vessel moored between a dock and two pilings in accordance with the present invention.

FIGS. 1 shows a boat 10 moored between a dock 20 and two pilings 21 and 22 in accordance with the present invention. On the starboard side of the boat 10, fixed lines 23 and 24 are attached to pilings 25 and 26 of dock 20. On the port side, the boat 10 is moored to pilings 21 and 22 by lines 42 and 28 through mooring means 30 and 39 in accordance with the present invention.

Figure 2:
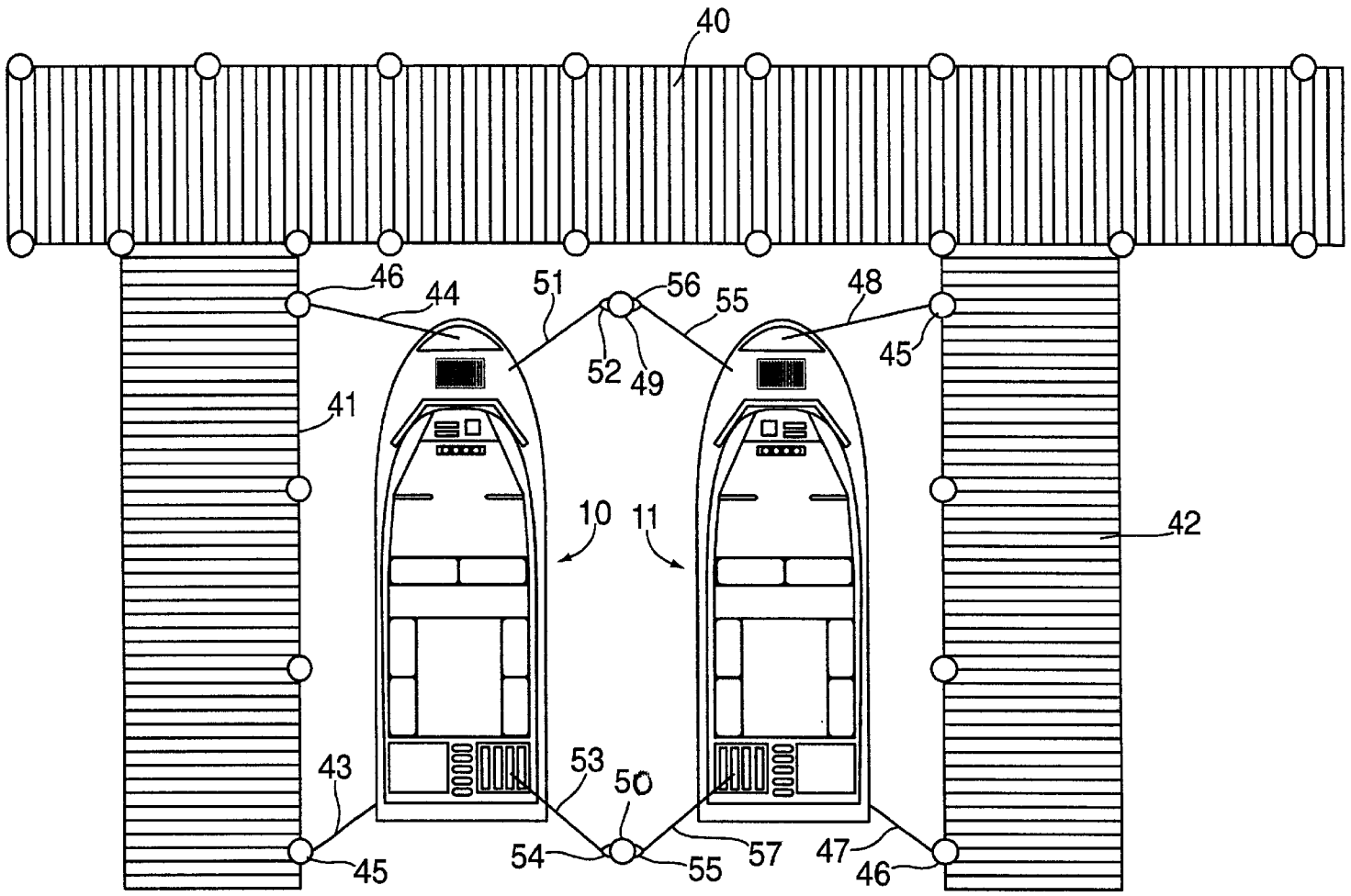
FIG. 2 is a top view of two vessels moored in a U-shaped dock in accordance with the present invention.

FIG. 2 shows two boats 10 and 11 moored to U-shaped dock 40 between dock extensions 41 and 42. Boat 10 is attached on its port side to dock extension 41 by fixed lines 43 and 44 tied to dock pilings 45 and 46, respectively. Similarly, boat 11 is moored to dock extension 42 on its starboard side by fixed lines 47 and 48 tied to pilings 45 and 46. Boats 10 and 11 are both moored to pilings 49 and 50, boat 10 on the starboard and boat 11 on the port. Boat 10 is attached to piling 49 by line 51 through mooring means 52 and to piling 50 by line 53 through mooring means 54. Boat 11 is attached to piling 49 by line 55 through mooring means 56 and to piling 50 by line 57 through mooring means 55.

Figure 3:
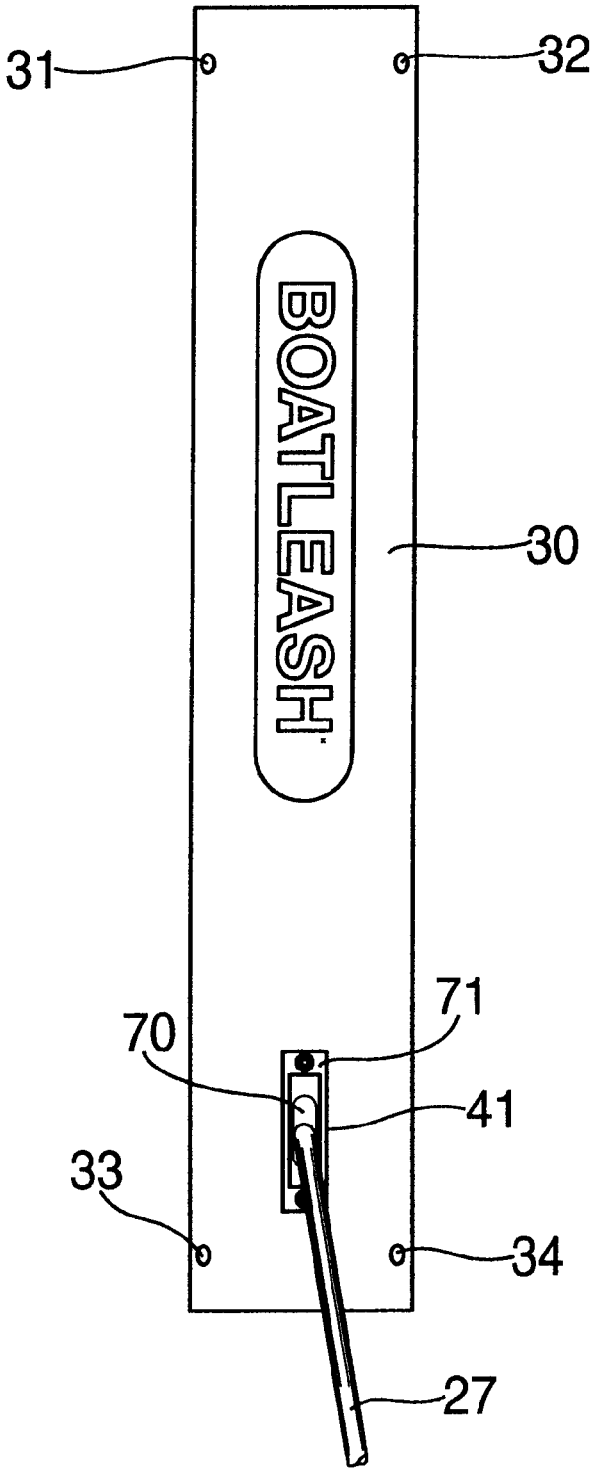
FIG. 3 front view of the mooring device of the present invention.
Figure 6:
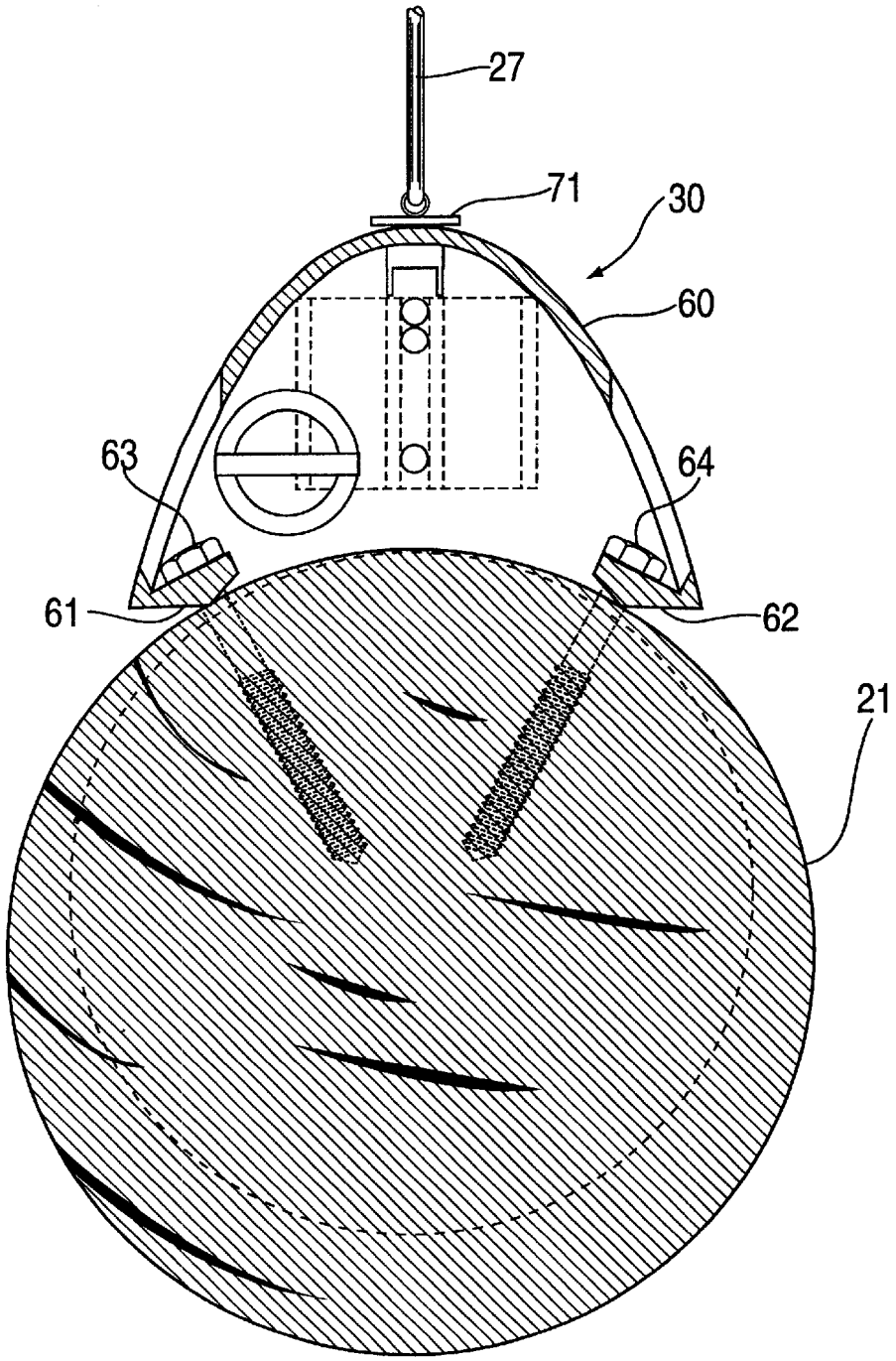
FIG. 6 is a plan cross-sectional view of the present invention taken on plane 6—6 Of FIG. 4 mounted on a piling with the internal spring and pulley shown.

As seen most clearly in FIG. 3 and 6, mooring means 30 is encased in an elongated convex outer shell 60 with inwardly directed lips 61 and 62 along its length. As seen more clearly in FIG. 4, the shell 60 has a bottom plate 80 and a top plate 85. Mooring means 30 is attached to its piling 21 by at least two screws 63 passing through lip 61 and at least two screws 64 passing through lip 62. The screws mounting the mooring means are accessible through openings 31, 32, 33 and 34 located on the outer shell 60 of the mooring means 30. Lips 61 and 62 may have pointed outer edges so that when screws 63 and 64 are tightened create a point of contact which sits according to the diameter of the piling 21 allowing for a variety of piling 21 diameters. FIG. 6 contains a dotted line within the cross section of the pilling to demonstrate the mooring means' ability to adapt to different sized pilings. Line 27 enters casing 60 at opening 70 which is protected by wear plate 71.

Figure 4:
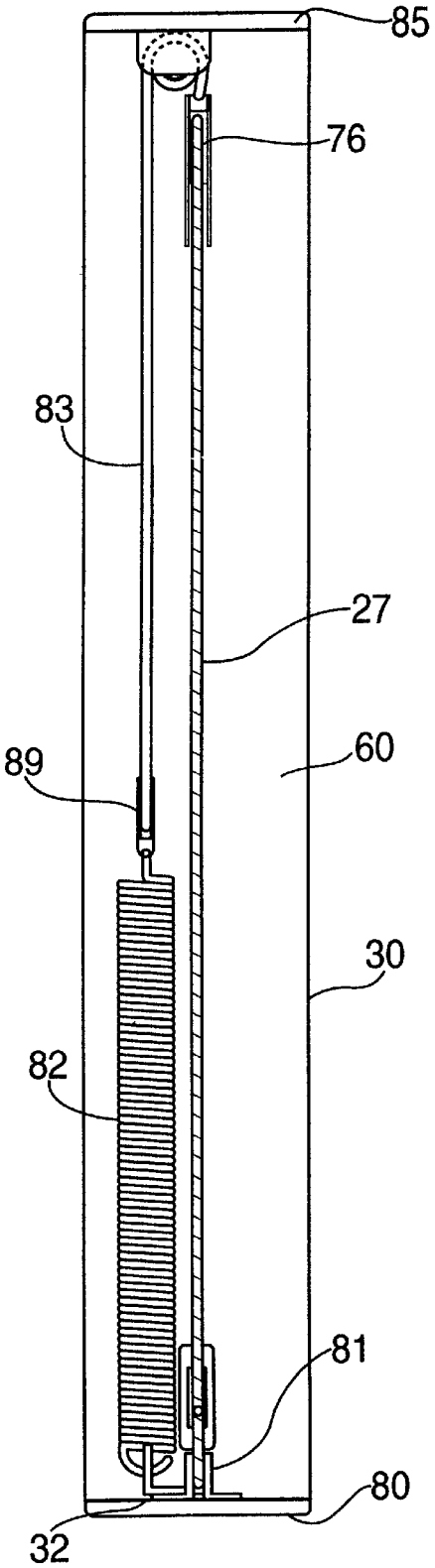
FIG. 4 is a front cross-sectional view of the present invention.
Figure 5:
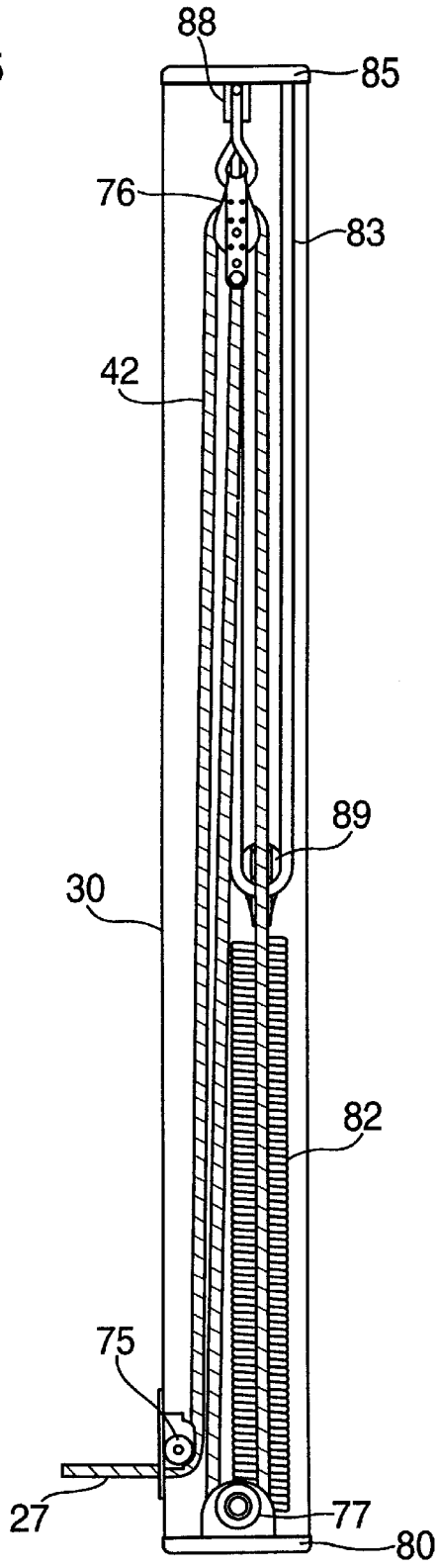
FIG. 5 is a side cross-sectional view of the present invention.

FIGS. 4 and 5 are cross-sectional views of the interior of the mooring device 30. The line 27 enters the casing 60 through opening 70. The opening 70 is protected by wear plate 71. It is then redirected to the vertical by wheel 75. The line 27 then passes through a floating pulley 76 and through a pulley 77 fixed to the bottom 80 of the mooring means 30 by clips. Also attached to the clips is spring 82. Pulley 89 is attached to the other end of spring 82. Line 83 is attached at one end to the top plate 85 of the mooring means 30, then passes through pulley 89 and then pulley 88 mounted on the top plate 85 of the mooring means 30. After leaving pulley 88, line 83 is attached to the frame of floating pulley 76. Line 27, after leaving fixed pulley 77 is also attached to the frame of floating pulley 76.

This arrangement of pulleys and lines allows for change in effective length substantially greater than the size of the mooring means 30 itself and allows for effective control of forces involved. For example, if substantial winds, waves or tides tend to push boat 10 from mooring means 30, the line 27 would be placed under tension. Since line 27 is passed over pulleys 76 and 77, the force is applied with mechanical advantage against line 83 which, in turn, applies that force with additional mechanical advantage through pulley 89 against spring 82. This would allow for substantial movement of the boat while maintaining the correct tension in the line 27. Equally, a slacking of the tension would allow for substantial shortening of the effective length of line 27. As an end result, the arrangement of pulleys and lines in a relatively short mooring device allows for extensive changes in the effective length and the application of force at appropriate levels due to the mechanical advantage inherent in the system.

It is understood that the present embodiment described above is to be considered as illustrative and not restrictive. It will be obvious to those skilled in the art to make various changes, alterations and modifications to the invention described herein. To the extent that these variations, modifications and alterations depart from the scope and spirit of the appended claims, they are intended to be encompassed therein.

We claim:

1. An apparatus for securing a boat to a dock or pilings, comprising:

an elongated housing adapted to be mounted on a dock or piling;

the elongated housing having a helical spring with one end fixed to one end of the elongated housing and the other end fixed to a bracket which contains a first pulley in such a manner that said first pulley may move within said elongated housing;

a first line attached to the opposite end of the elongated housing from which said helical spring is fixed to the elongated housing, said first line positioned partially around said first pulley and around a second pulley, the other end of said first line being attached to a bracket for holding a third pulley; and a second line passing through said third pulley for attachment to a boat or other object to be moored.

2. An apparatus according to claim 1 in which the one end of the second line is attached to the bracket holding said third pulley.

3. An apparatus according to claim 2 wherein the first line and the second line are attached to opposite ends of the bracket holding said third pulley so that the positioning of the third pulley is controlled by the tension in the first and second line.

4. An apparatus according to claim 3 wherein said second line passes partially around a fourth pulley between the attachment to the third pulley bracket and the third pulley.

5. An apparatus according to claim 4 wherein said second line exits out of the elongated housing through an opening in said elongated housing in the vicinity of said fourth pulley.

6. An apparatus according to claim 5 wherein said second line passes over a roller.

7. An apparatus according to claim 6 wherein said first pulley and said second pulley are at right angles to each other.

8. An apparatus according to claim 7 wherein said first pulley and said fourth pulley are parallel to each other.

9. An apparatus according to claim 8 wherein said first pulley and said third pulley are parallel to each other.

10. An apparatus according to claim 9 wherein said first pulley, third pulley, fourth pulley and roller are parallel to each other.

11. An apparatus according to claim 10 wherein said roller is a fifth pulley.

12. An apparatus according to claim 1 wherein said elongated housing has a lip on each side for mating with a dock or piling.

13. An apparatus according to claim 12 wherein each lip further comprises at least two openings for fastening said apparatus to a dock or piling.

14. An apparatus according to claim 13 further comprising at least four openings in the exterior of said elongated housing.

* * * * *